United States Patent [19]

Tremblay

[11] Patent Number: 4,875,244

[45] Date of Patent: Oct. 24, 1989

[54] SOFA BED CONSTRUCTION

[75] Inventor: Gilles Tremblay, Quebec, Canada

[73] Assignee: Futonair Quebec, Inc., Quebec, Canada

[21] Appl. No.: 170,287

[22] Filed: Mar. 18, 1988

[30] Foreign Application Priority Data

Mar. 27, 1987 [CA] Canada ..... 533191

[51] Int. Cl.[4] ..... A47C 17/16

[52] U.S. Cl. ..... 5/37 R; 5/47

[58] Field of Search ..... 5/37 R, 47

[56] References Cited

U.S. PATENT DOCUMENTS

| | | | |
|---|---|---|---|
| 1,876,405 | 9/1932 | Karpen | 5/47 |
| 2,209,880 | 7/1940 | Fox | 5/47 |
| 2,288,775 | 7/1942 | Bell | 5/47 |
| 2,319,337 | 5/1943 | McDaniel | 5/47 |
| 2,321,206 | 6/1943 | Holcomb | 5/47 |
| 2,694,814 | 11/1954 | Doner | 5/47 |
| 3,042,935 | 7/1962 | Nielsen | 5/47 |
| 3,107,364 | 10/1963 | Simmons | 5/47 |
| 3,634,893 | 1/1972 | Hern et al. | 5/37 R |
| 4,569,093 | 2/1986 | Hermann | 5/47 |
| 4,642,823 | 2/1987 | Wiggins | 5/37 R |
| 4,737,996 | 4/1988 | Tiffany | 5/37 R |

FOREIGN PATENT DOCUMENTS

| | | | |
|---|---|---|---|
| 513134 | 10/1952 | Belgium | 5/47 |
| 807008 | 4/1951 | Fed. Rep. of Germany | 5/47 |
| 1058068 | 3/1954 | France | 5/47 |
| 1105722 | 7/1955 | France | 5/41 |
| 1267872 | 6/1961 | France | 5/37 |
| 58518 | 10/1937 | Norway | 5/47 |
| 894561 | 4/1962 | United Kingdom | 5/47 |

*Primary Examiner*—Gary L. Smith
*Assistant Examiner*—Eric K. Nicholson
*Attorney, Agent, or Firm*—Lahive & Cockfield

[57] ABSTRACT

A sofa bed features a back piece means pivotally secured to a seat piece means. The back piece means includes dowels which protrude from either side of a side segment of the back piece and an extension portion. The frame of the sofa bed also includes a horizontal groove which is attached to an inside portion of an armrest stand of the sofa bed. A triangular block means attached to an outside portion of the seat piece means, is instrumental in facilitating the easy and efficient operation of the sofa bed. When the sofa bed is in the bed position, it may be converted to a sofa by lifting up on the seat piece until the block means is positioned over the side segment causing the block means to exert a downward force on the extensions, thereby pivoting the back piece to a vertical position while the dowel slides backwardly within the groove.

1 Claim, 5 Drawing Sheets

SOFA BED CONSTRUCTION

BACKGROUND OF THE INVENTION

The present invention relates to frames for convertible sofas. More particularly, the invention relates to a mechanism to effect the conversion of a sofa or the like into a bed, and vice versa.

Convertible sofas and futon bases are well known in the art. However, known convertible sofas and futon bases often require a great deal of effort to be converted from one configuration, such as a sofa, into another configuration, such as a bed. Usually, when a futon base or sofa bed is in the sofa configuration, it must be moved a substantial distance from a wall in order to be able to be converted into a bed. Even if the furniture is not positioned near a wall, it usually requires a great deal of effort to convert the furniture from its sofa position to its bed position. To convert the bed into a sofa, the user must pull up the portion of the sofa which will form the seat back, block it, and then move the sofa against the wall or to its desired position. Such convertible furniture pieces not only require a great deal of effort to manipulate, but also result in a time consuming process which is not always easily performed by one person.

SUMMARY OF THE INVENTION

It is accordingly an object of the present invention to provide a sofa or futon base which may be easily converted to a bed, and easily reconverted to the sofa position. An additional object of the invention is to provide a mechanism which facilitates the virtually effortless adjustment of the convertible sofa between the bed and sofa configurations. Additional objects of this invention will be apparent to those having ordinary skill in the art upon reading this disclosure.

The above objects are accomplished by providing a convertible furniture frame, that is, one which is able to be configured in both the sofa and bed positions. The frame includes a back piece which may be positioned substantially vertically (to form a sofa) or horizontally (to form a bed). The back piece is hinged to a seat piece which remains in the horizontal position, but which may slide horizontally in order to accommodate the sofa and bed positions of the sofa bed. The back piece and seat piece are hingedly connected as the seat piece is sandwiched between two extending side segments of the back piece and a screw or other suitable fastening device is used to hingedly secure the two pieces.

The mechanism which enables the furniture piece to be easily converted between sofa and bed positions comprises a pivoting triangular block, the apex portion of which is pivotally hinged to a side segment of the seat piece. A horizontally oriented groove is attached to the arm piece of the sofa and a dowel which protrudes from either side of a side segment of the back piece is slidingly engaged therein. When the furniture is positioned in its bed configuration, it may be converted to the sofa configuration by simply raising the seat portion of the sofa, causing the triangular block to pivot such that the force of gravity causes the base of the block to face directly downwardly. When the base of the block is positioned directly over the extending side segments of the back piece, the seat piece is forced downwardly, causing the base of the triangular block to exert a downward force on the extending side segments of the back piece. When this happens, the back piece is pivoted from the horizontal position to a substantially vertical position and the dowel slides from a forward position to a backward position within the horizontal groove mounted on each of the arm portions of the sofa. When the back piece is in its predetermined vertical position the sofa may be secured in place by interlocking a notch in a bottom portion of the seat piece with a portion of the sofa frame.

To convert the furniture piece from the sofa position to the bed position, one may simply raise the seat portion slightly such that the notch in the seat portion clears the frame of the sofa. The user may then pull the seat piece forward, thereby causing the dowel to slide forwardly in the horizontal groove while the back piece pivots to the horizontal position.

DETAILED DESCRIPTION OF THE INVENTION

Figure 1:
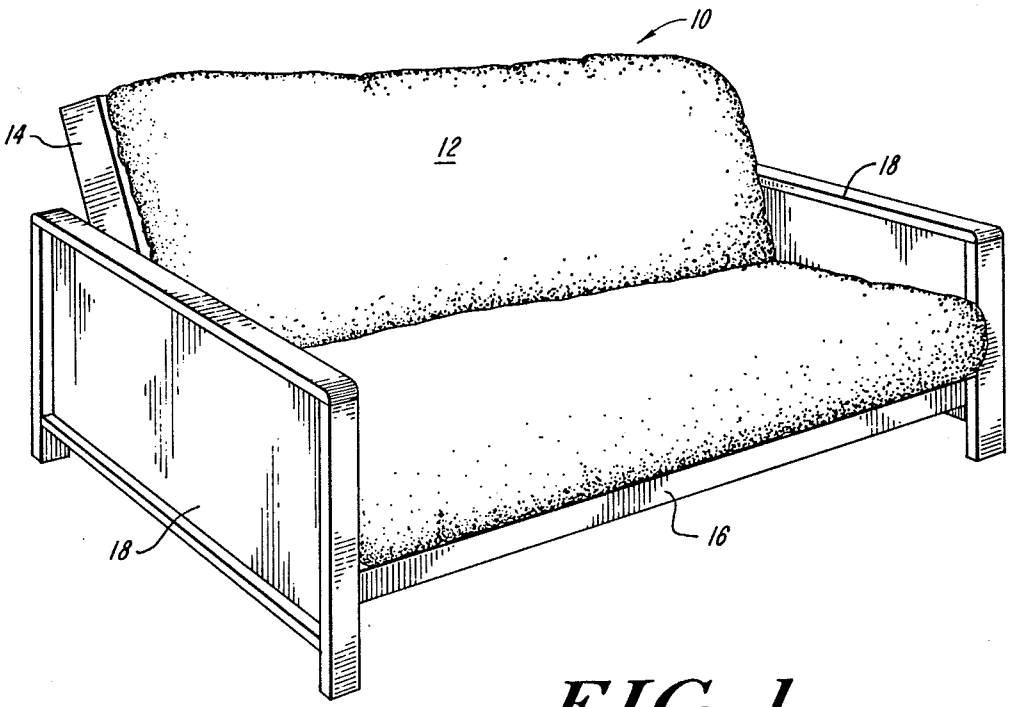
FIG. 1 is a perspective view of a sofa bed of the present invention.

Referring to FIG. 1, the sofa bed 10 of the present invention comprises a cushion or futon pad 12 which is supported by a back piece 14 and a seat piece 16. The back and seat pieces, in turn, are supported by armrest stand 18. A frame structure 32 (shown in FIG. 2) is connected between the armrest stands and provides additional support for the sofa bed 10. The sofa bed 10 of the present invention may alternatively be termed a futon frame.

The cushion 12 may be virtually any type of cushion or mattress material suitable for use with a sofa bed. One preferred type of cushioning material is, however, a futon pad.

FIGS. 2–5 illustrate the mechanism of the sofa bed 10 of the present invention which enables it to be easily converted between sofa and bed configurations. While only one side of the sofa bed is illustrated in FIGS. 2–5, it is understood that the mechanism is the same on both sides of the sofa bed frame.

Figure 2:
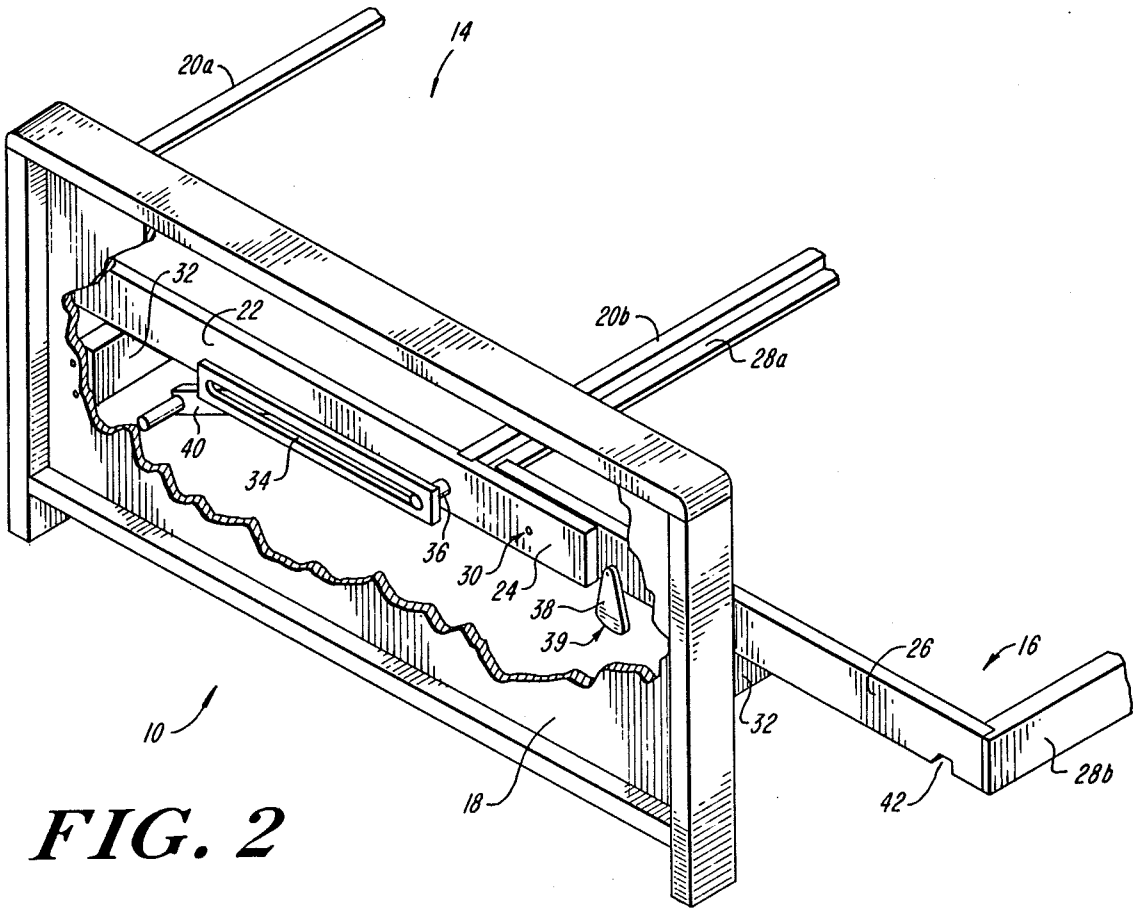
FIG. 2 is a perspective view, partially cutaway, of one side of the sofa bed of the present invention, illustrating the converter mechanism of the present invention while in the bed position.

FIG. 2, which depicts the sofa bed in the bed configuration, best illustrates the sofa bed construction of the converter mechanism in the present invention. A back piece 14 comprises cross bar segments 20*a, b* which connect to side segments 22 to form a back piece 14 having a substantially rectangular shape. The side segments also include extensions 24 at one end thereof which extend beyond cross bar 20*b*. A seat piece 16 also has a generally rectangular shape and is formed by the joinder of two side segments 26 and two cross bars 28*a* and *b*. The seat piece 16 is hingedly secured to the back piece as it is sandwiched between the extensions 24 of the back piece side segments 22 as shown in FIG. 2, and secured thereto by a fastening means 30. The back and seat pieces are mounted on a sofa frame 32 which spans two opposed armrest stands 18.

As best shown in FIG. 2, a horizontally oriented groove 34 is attached to the armrest stand 18. Groove 34 receives a dowel 36 which extends from side segment 22 of back piece 14. Dowel 36 is adapted to be horizontally slidable within groove 34. The converter mechanism further comprises a pivoting triangular block 38 which is pivotally secured to the outside surface of side segment 26 of the seat piece 16. The triangular block 38 is mounted to side segment 26 slightly forward of the end of side segment extension 24. The frame may also include a strut means 40 which is secured to the side segment and changes its orientation with the change in configuration of the sofa bed.

FIGS. 2–5 sequentially illustrate the operation of the converter mechanism as it is used to convert a sofa bed from the bed position to the sofa position. In FIG. 2 the sofa bed is in the bed configuration with the back piece 14 and the seat piece 16 horizontally positioned adjacent to each other. The back piece 14 and seat piece 16 thus cooperate to provide a flat surface upon which to mount mattress 12. When positioned in the bed configuration, dowel 36 is located at the forward-most end of groove 34.

Figure 3:
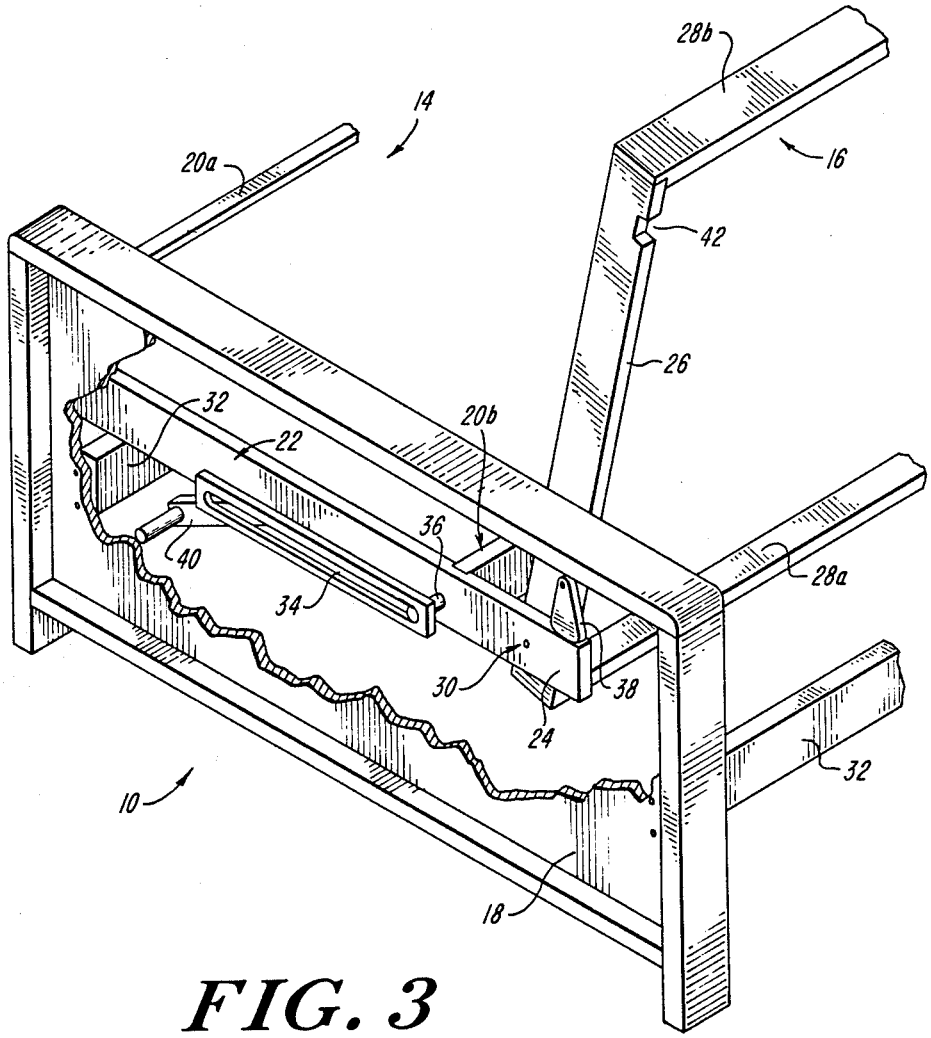
FIG. 3 is a side perspective view, partially cutaway, of the mechanism of FIG. 2 while the sofa bed is being converted from the bed position to the sofa position.
Figure 4:
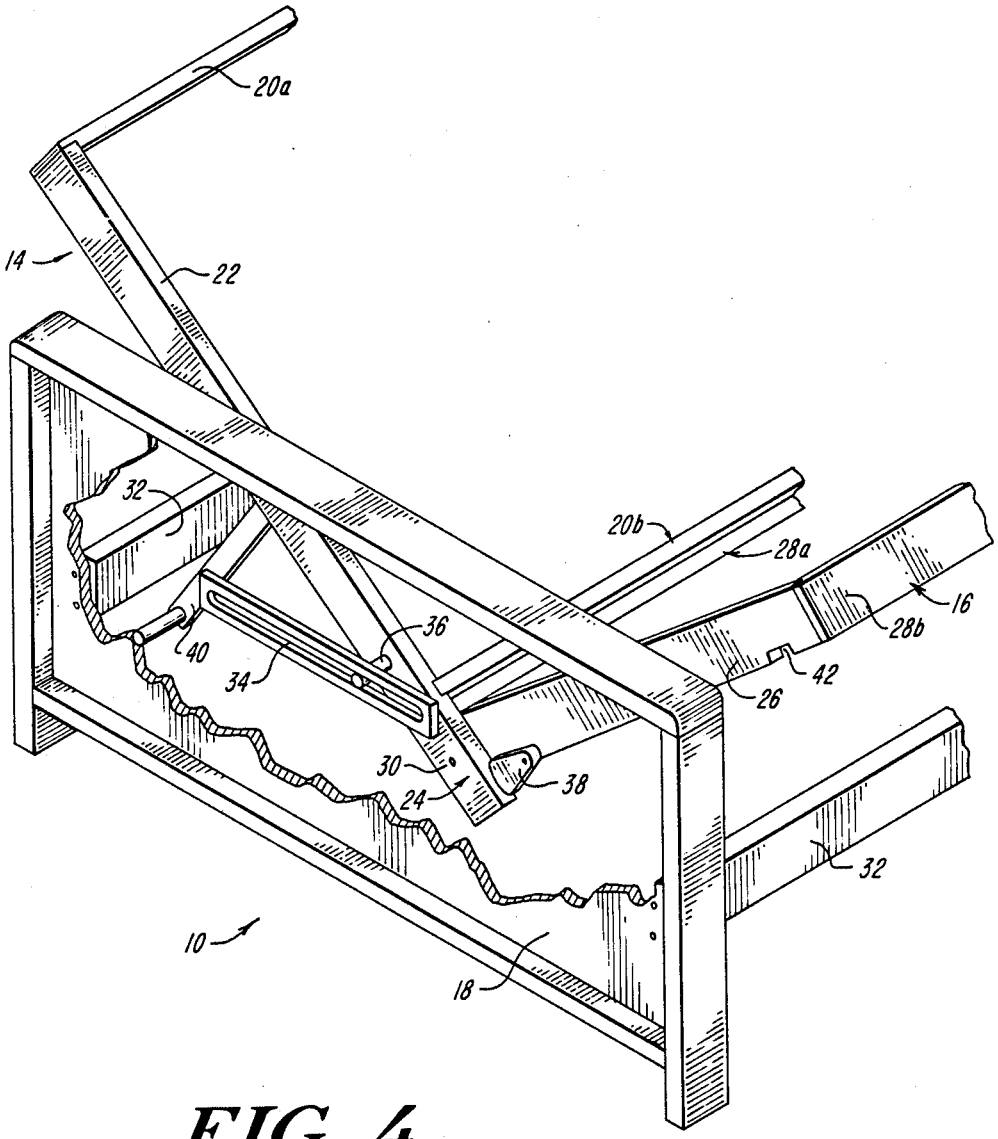
FIG. 4 is a perspective view, partially cutaway, of the mechanism of FIG. 2, showing the sofa bed as it is being converted from the bed position to the sofa position.
Figure 5:
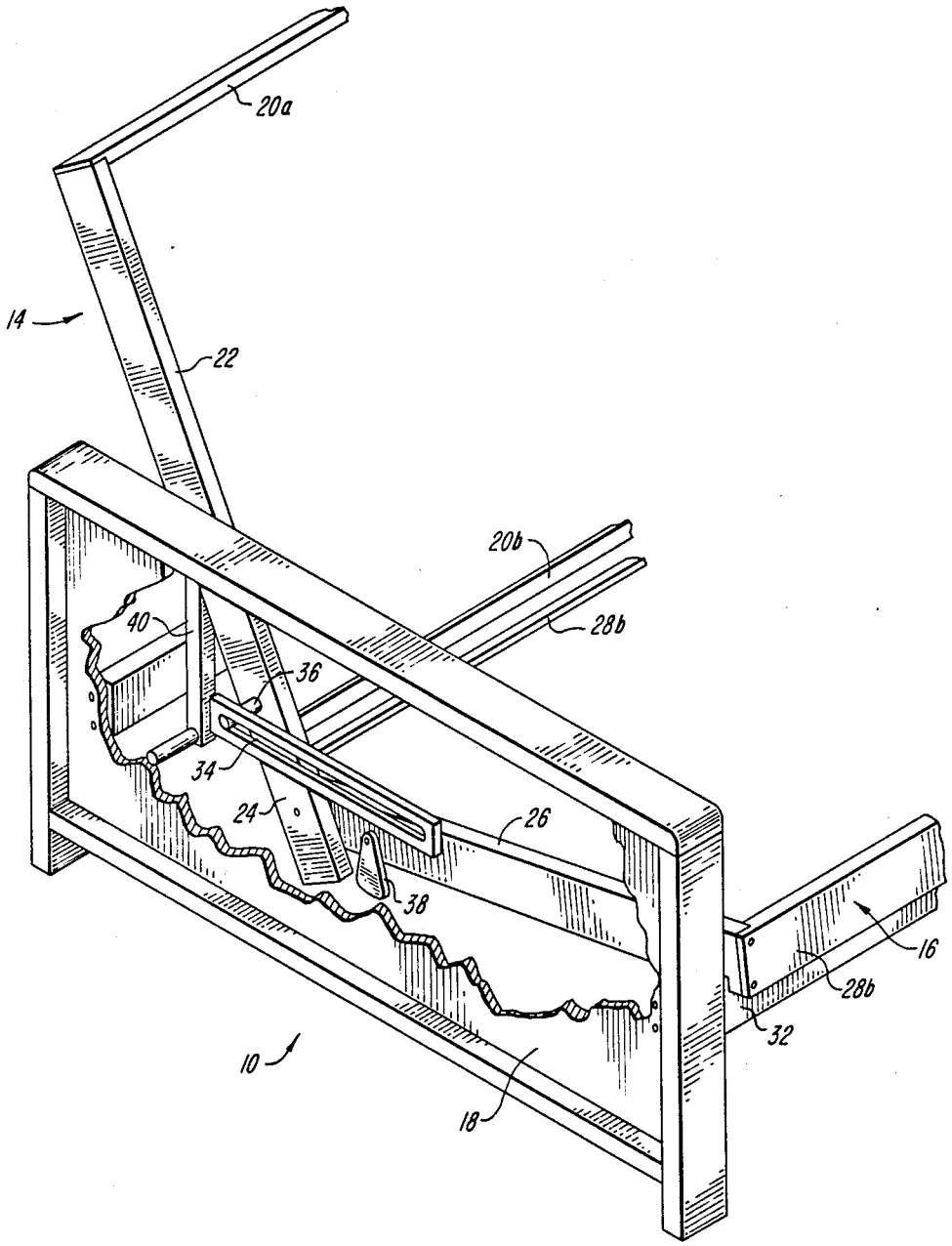
FIG. 5 is a perspective view, partially cutaway, of the mechanism of FIG. 2, illustrating the mechanism of FIG. 2, while the sofa bed of the present invention is in the sofa position.

To convert the sofa bed from the bed position to the sofa position, one may simply raise the seat piece 16 by grasping cross bar **28*b*. The forward portion of seat piece 16 is elevated, causing it to pivot in counterclockwise direction about fastening means 30 such that a base portion 39 of triangular block 38 becomes positioned just above the top surface of extension 24. Next, a downward force is exerted on cross bar 28*b* causing the seat piece 16 to pivot in a clockwise direction about fastening means 30 such that a downward force is exerted on extension 24 by the base portion of block 38 as shown in FIG. 3. As the downward force is continued to be applied to cross bar 28*b*, the back piece is raised as it also pivots in a clockwise direction about fastening means 30. At the same time, dowel 36 slides backwards within groove 34 as shown in FIG. 4. Eventually, as shown in FIG. 5, the dowel will have reached the back end of groove 34. At this point, the furniture piece is in the full sofa position and the triangular block no longer contacts extension 24 and is free to rotate back to its normal position. In the sofa position, strut 40 is in the substantially vertical position as shown in FIG. 5. In a preferred embodiment, the sofa bed may be secured in the sofa position by engaging a notch 42 formed in the bottom surface of side segments 26** with a portion of the frame.

In order to return to the bed position, one may simply lift up on cross bar **28*b* and pull the seat piece 16 forward. This causes dowel 36 to move to the forward end of groove 34** as the back piece pivots to a horizontal position. When the back piece and the seat piece are in alignment and are fully horizontal, the sofa bed is secured in the bed position.

The frame of the sofa bed, as well as the components of the converter mechanism, of the present invention is preferably constructed of wood. However, other materials such as structural plastics and metal may be used.

Having described the invention, what is claimed is:

1. A wooden furniture frame adaptable to be converted between sofa and bed positions, comprising:

a substantially rectangular back piece means having opposed first side segments connected by opposed upper and lower cross bars, said first side segments having extension segments which extend beyond a lower cross bar;

a rectangular seat piece means having opposed second side segments connected by opposed forward and rearward cross bars, the rearward portion of the second side segments being positioned within and pivotally hinged to the extension segments of the back piece means;

opposed armrest stand means connected by support frame means to support said back support frame and said seat support frame;

dowel means extending from the first side segments of the back support frame;

elongate, horizontally disposed groove means, attached to an interior portion of said armrest stand means for slidably receiving said dowel means;

block means pivotally secured to the outer surfaces of said second side segments of the seat piece means, having a base portion and being adapted to engage a top surface of said extension segment with said base portion when said seat piece means is pivotally raised to a predetermined height;

said block means comprising a substantially triangular member which is pivotable about a point adjacent an apex of said back means, and is freely rotatable such that its base portion normaly faces downwardly under the influence of gravitational force when the frame is in either its sofa or bed position; and a notch means in the forward cross bar of said seat piece means, said notch being adapted to interlock with a portion of said frame means to secure said furniture frame in the sofa position.

* * * * *